US005616087A

United States Patent [19]

Bothwell

[11] Patent Number: 5,616,087

[45] Date of Patent: Apr. 1, 1997

[54] GOLF CLUB

[76] Inventor: Charles R. Bothwell, 1641 Alvarado Ave., Apt. 4, Walnut Creek, Calif. 94596

[21] Appl. No.: 572,637

[22] Filed: Dec. 14, 1995

[51] Int. Cl.[6] ..... A63B 53/16

[52] U.S. Cl. ..... 473/316; 473/288; 473/313; 473/294

[58] Field of Search ..... 473/316, 323, 473/287, 288, 314, 298, 299, 289, 292, 294, 313; 273/81.6, 81.3, 80.1, 80 C

[56] References Cited

U.S. PATENT DOCUMENTS

| | | | |
|---|---|---|---|
| D. 256,824 | 9/1980 | Ward et al. . | |
| 3,874,668 | 4/1975 | Flege . | |
| 4,227,694 | 10/1980 | Drake . | |
| 4,621,816 | 11/1986 | Leek . | |
| 4,625,965 | 12/1986 | Mullins . | |
| 4,795,153 | 1/1989 | Thomas | 473/316 |
| 5,308,073 | 5/1994 | McKoon et al. . | |
| 5,328,185 | 7/1994 | Finnigan et al. . | |

FOREIGN PATENT DOCUMENTS

| | | | |
|---|---|---|---|
| 710688 | 6/1965 | Canada | 273/81.3 |

OTHER PUBLICATIONS

LaBauve, Mile. *Your Angle For Distance,* Sep. 1995/Golf Digest pp. 60–67.

*Primary Examiner*—Mark S. Graham
*Attorney, Agent, or Firm*—Thomas R. Lampe

[57] ABSTRACT

A golf club including a club shaft having two shaft segments offset from one another to bring the club head of the club closer to the golfer employing the club than would be the case if the club shaft were straight along its entire length. The club is part of a set of golf clubs wherein the offset is greater in shorter clubs of the set than in longer clubs of the set.

8 Claims, 5 Drawing Sheets

GOLF CLUB

TECHNICAL FIELD

This invention relates to a golf club construction which improves the swing of a golfer.

BACKGROUND ART

Golf clubs typically employ shafts which are straight between the club head and the club handle. A wide variety of materials have been and are employed in the construction of such shafts.

Golf clubs, particularly putters, have been proposed which employ shafts which are not straight in an attempt to improve club performance. The clubs shown in the following U.S. patents are believed to be representative of the state of the art in so far as non-straight club shafts are concerned: U.S. Pat. No. 3,874,668, issued Apr. 1, 1975, U.S. Pat. No. Des. 256,824, issued Sep. 9, 1980, U.S. Pat. No. 4,227,694, issued Oct. 14, 1980, U.S. Pat. No. 4,625,965, issued Dec. 2, 1986, U.S. Pat. No. 4,621,816, issued Nov. 11, 1986, U.S. Pat. No. 5,308,073, issued May 3, 1994, and U.S. Pat. No. 5,328,185, issued Jul. 12, 1994. The above-noted patents all relate to golf putter constructions which allegedly improve a golfer's putting stroke. The arrangements shown in the patents appear to be inappropriate insofar as construction of golf clubs other than putters is concerned.

DISCLOSURE OF INVENTION

The present invention relates to a golf club construction which has application not only to putters but also to other golf clubs. A club constructed in accordance with the teachings of the present invention has been found to dramatically improve a golfer's swing. As will be seen in greater detail below, utilizing the principals of the present invention, the club head is brought closer to a golfer's body than would be the case where a conventional straight club shaft is employed. This puts the center of gravity of the club closer to the golfer and provides more control by the golfer resulting in greater distance and accuracy. Also, the club provides a better "feel" of the club head during the swing.

It is well known that attaining "the correct angle" between the golfer's lead arm (left arm for most golfers) and the club shaft early in the back swing is of fundamental importance. A golf club constructed in accordance with the teachings of the present invention makes it easier to achieve and maintain "the correct angle" during the swing. The September, 1995 issue of *Golf Digest* provides an excellent discussion of the principle of "the correct angle" generally.

The golf club construction disclosed and claimed herein includes a club head having a golf ball engaging surface.

A club shaft is fixedly attached to the club head and extends upwardly from the club head.

The club shaft includes a substantially straight first club shaft segment extending upwardly from the club head along a first imaginary line. A substantially straight second club shaft segment adjoins and is connected to the first club shaft segment and extends upwardly and laterally relative to the first club shaft segment. A substantially straight third club shaft segment adjoins and is connected to the second club shaft segment at a location spaced from the first club shaft segment and extends upwardly from the second club shaft segment in a second imaginary line spaced from the first imaginary line.

An elongated club handle is connected to the third club shaft segment at a location spaced from the second club shaft segment. The club handle is offset relative to the first club shaft segment. The first imaginary line intersects the ground at a location closer to a golfer holding the golf club by the club handle and swinging the golf club to strike a golf ball than the location of intersection between the second imaginary line and the ground at the time of golf ball contact by the golf ball engaging surface.

In an embodiment of the invention, the first, second and third club shaft segments are non-integral and releasably connected together. The second club shaft segment is one of a plurality of inserts of differing sizes selectively alternatively connectable to the first and third club shaft segments to selectively vary the distance between the first imaginary line and the second imaginary line.

Other features, advantages, and objects of the present invention will become apparent with reference to the following description and accompanying drawings.

MODES FOR CARRYING OUT THE INVENTION

Figure 1:
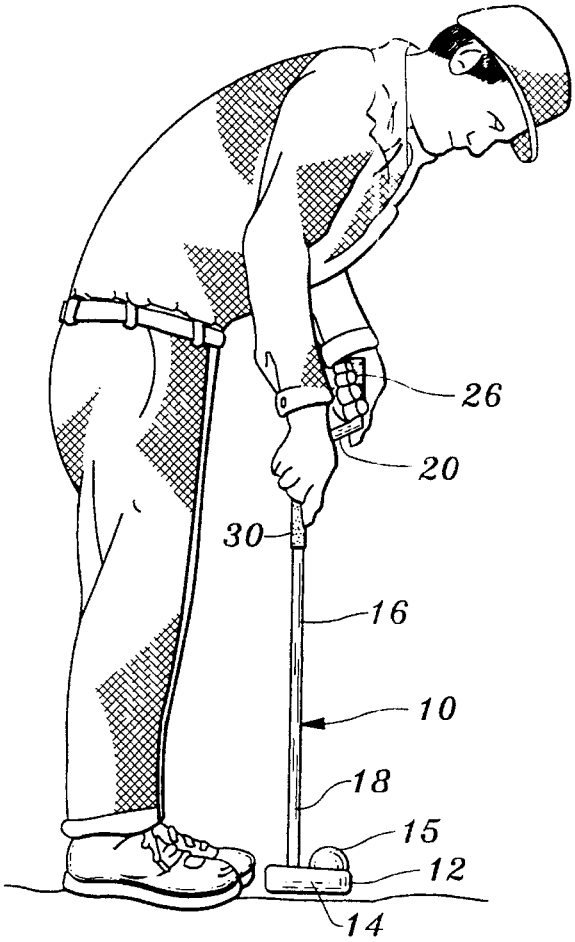
FIG. 1 is a side view showing a golfer with a putter constructed in accordance with the teachings of the present invention.
Figure 6:
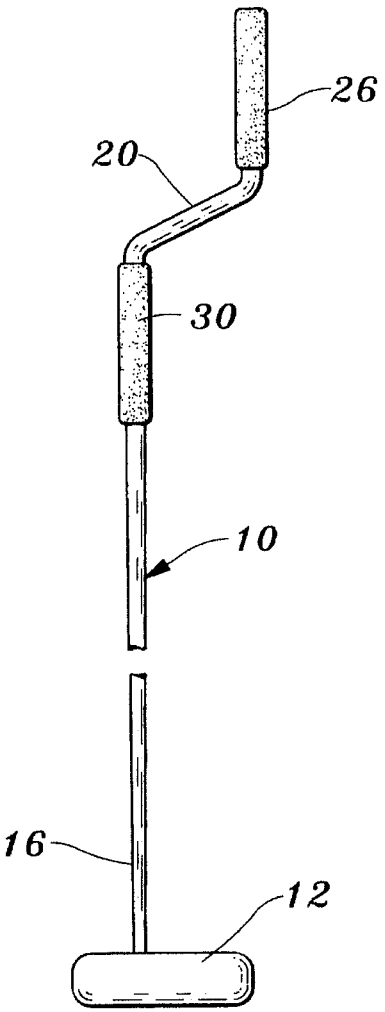
FIGS. 5 and 6 are elevational side views of two different embodiments of the putter.

FIG. 1 shows a golfer holding a putter 10 constructed in accordance with the teachings of the present invention. Putter 10 is also shown in FIG. 6.

The club 10 includes a club or putter head 12 having a golf ball engaging surface (the surface opposed to visible surface 14) engaging ball 15.

A club shaft 16 is fixedly attached to the club head and extends upwardly from the club head.

Club shaft 16 includes a substantially straight first club shaft section or segment 18 extending upwardly from the club head along a first imaginary line.

The shaft also includes a substantially straight second club shaft segment 20 adjoining and connected to the first club shaft segment extending upwardly and laterally relative to the first club segment.

A substantially straight third club shaft segment 22 adjoins and is connected to the second club shaft segment at a location spaced from the first club shaft segment and extending upwardly from the second club shaft segment along a second imaginary line spaced from the first imaginary line.

An elongated club handle 26 is connected to the third club shaft segment 22 at a location spaced from the second club shaft segment. In the arrangement illustrated, the handle surrounds most of the third club shaft segment. The club handle is offset relative to the first club shaft segment and the first imaginary line intersects the ground at a location closer to the golfer holding the club by the handle 26 than the location of intersection between the second imaginary line and the ground at the time of golf ball contact by the golf ball engaging surface. Putter 10 also includes a second handle 30 spaced below second club shaft segment 20, each handle being engaged by a hand of the golfer as shown.

Figure 5:
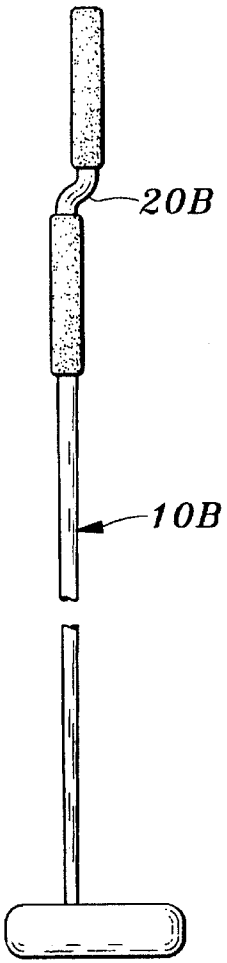
Figure 4:
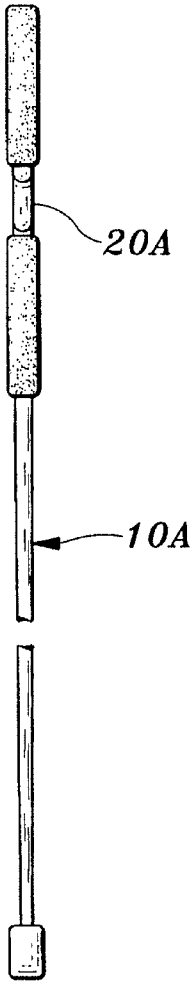
FIG. 4 is a front elevation view of the putter of FIG. 3.
Figure 3:
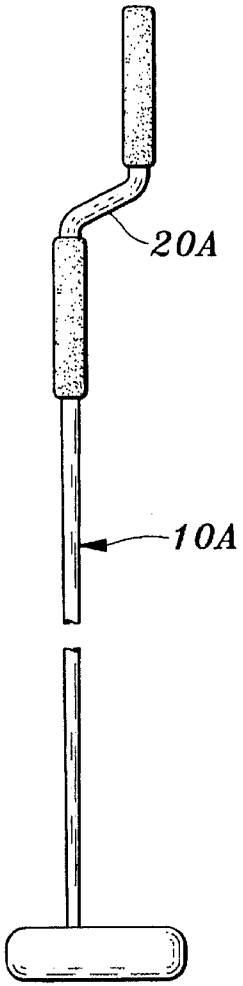
FIG. 3 is an elevational side view of one embodiment of the putter.

FIGS. 3 and 4 illustrate an alternate embodiment of the putter 10A wherein the second club segment 20A is somewhat shorter than that of the putter shown in FIGS. 1 and 6. FIG. 5 illustrates putter embodiment 10B having an even shorter second club shaft segment 20B.

Figures 7, 8, 9, 10, 11:
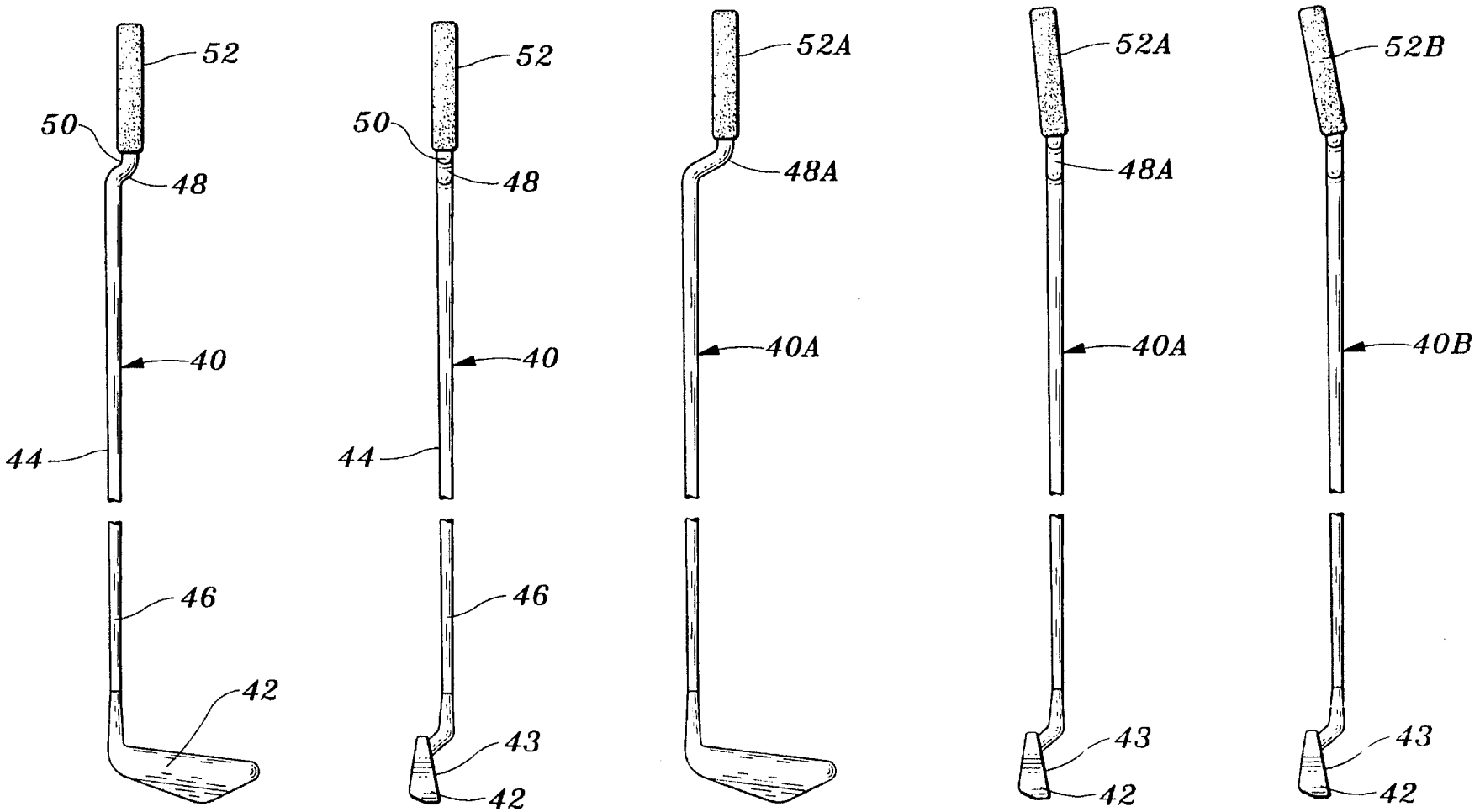
FIG. 7 is a elevational side view of an iron constructed in accordance with the teachings of the present invention.
FIG. 8 is a front elevation view of the iron of FIG. 7.
FIG. 9 is an elevational side view of an alternative embodiment of an iron.
FIG. 10 is a front elevation view of the iron of FIG. 9.
FIG. 11 is a view similar to FIG. 10 but illustrating an alternative form of iron.

FIGS. 7 and 8 illustrate a club in the form of a wedge 40 incorporating the teachings of the present invention. Wedge 40 includes a club head 42 having a club face or ball engaging surface 43 and a shaft 44 fixedly attached to the club head.

The club shaft 44 is of integral construction and includes first club shaft segment 46 extending upwardly from the club head, a substantially straight second club shaft segment 48 adjoining and connected to the first club shaft segment and extending upwardly and laterally relative to the first club shaft segment, and a substantially straight third club shaft segment adjoining and connected to the second club shaft segment at a location spaced from the first club shaft segment.

An elongated club handle 52 is connected to the third club shaft segment at a location Spaced from the second club shaft segment, the club handle being offset relative to the first club shaft segment.

The first club shaft segment is disposed along an imaginary line which is spaced from a second imaginary line extending through the third club shaft segment. As will be seen in greater detail below, the imaginary line along which first club shaft segment 46 extends is closer to a golfer at the point of interception of the imaginary line and the ground than is the second imaginary line at its point of intersection with the ground when the head 42 makes contact with a golf ball on the ground during the swing.

FIGS. 9 and 10 illustrate a wedge 40A which differs from wedge 40 in two respects. First of all, the club 40A incorporates a second club shaft segment 48A which is longer than the corresponding club shaft segment 48 of wedge 40. In addition, the club handle 52A of wedge 40 is canted in a forward direction, i.e. in the direction of the swing of wedge 40A.

FIG. 11 shows another alternative embodiment 40B of the wedge wherein the handle 52B is canted at an even greater degree of inclination than handle 52A of wedge 40A.

Figure 2:
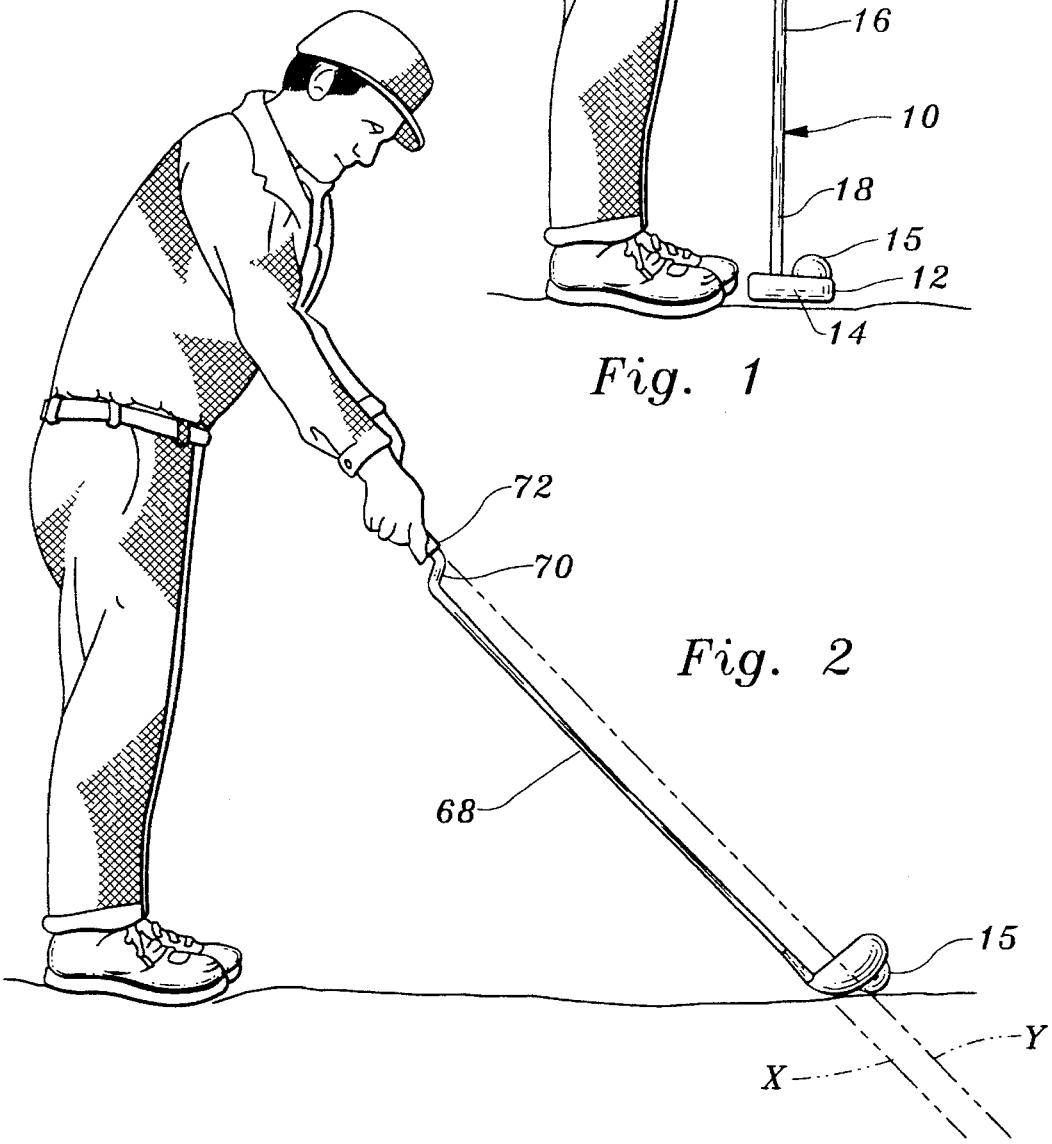
FIG. 2 is a side view, showing a golfer with a driver constructed in accordance with the teachings of the present invention.
Figures 12, 13, 14, 15, 16:
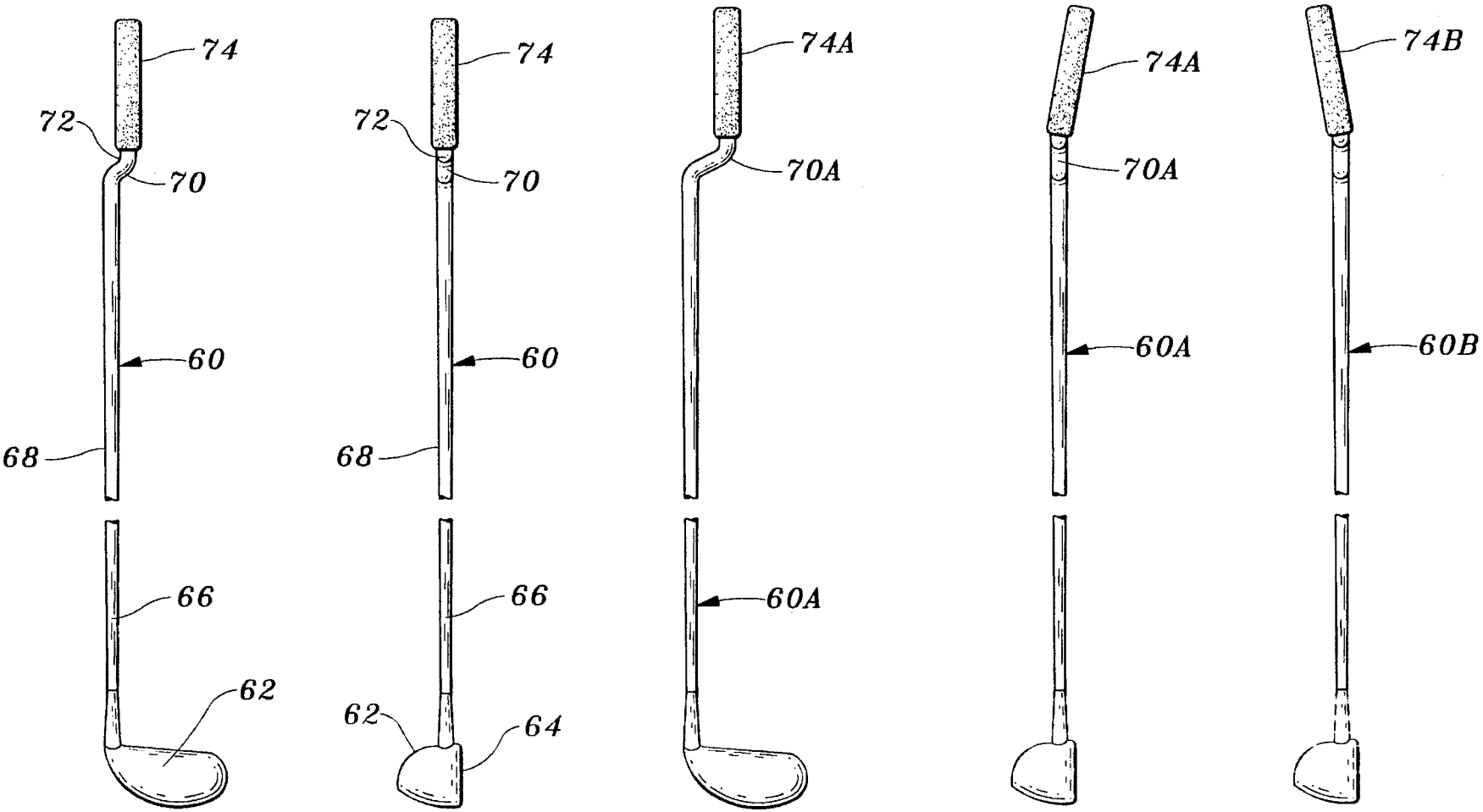
FIG. 12 is an elevational side view of a wood constructed in accordance with the teachings of the present invention.
FIG. 13 is a front elevation view of the wood of FIG. 12.
FIG. 14 is an elevational side view of an alternate embodiment of wood.
FIG. 15 is a front elevation view of the wood of FIG. 14.
FIG. 16 is a front elevation view of yet another embodiment of wood.

FIGS. 12 and 13 illustrate a club in the form of a driver 60 including a club head 62 having a golf ball engaging surface 64. FIG. 2 shows a golfer swinging club 60.

Club 60 also includes a club shaft 66 including a substantially straight first club shaft segment 68 extending upwardly from the club head along a first imaginary line (designated by the reference letter X in FIG. 2). A substantially straight second club shaft segment 70 adjoins and is integrally connected to the first club shaft segment and extends upwardly and laterally relative to the first club shaft segment. A substantially straight third club shaft segment 72 adjoins and is integrally connected to the second club shaft segment at a location spaced from the first club shaft segment. The third club shaft segment extends upwardly from the second club shaft segment along a second imaginary line (designated line Y in FIG. 2) spaced from first imaginary line X.

An elongated club handle 74 is connected to the third club shaft segment at a location spaced from the second club shaft segment, the club handle being offset relative to the first club shaft segment.

Referring now to FIG. 2, it is to be noted that the first imaginary line X intersects the ground at a location closer to a golfer holding the golf club by the handle and swinging the golf club to strike a golf ball than is the location of intersection between the second imaginary line Y and the ground at the time of golf ball contact by the golf ball engaging surface of the club head, i.e. when the club head is at or near the bottom of the swing.

FIG. 14 shows an alternative embodiment of the wood 60A wherein the second club shaft segment 70A is somewhat longer than second club shaft segment 70 of club 60.

Wood 60A is also shown in FIG. 15 in an elevational front view. It is to be noted that handle 74A is canted forwardly, i.e. in the direction of the club swing. FIG. 16 illustrates an arrangement similar to that shown in FIGS. 14 and 15 except that a handle 74B of the wood 60B is canted rearwardly relative to the first club shaft segment.

It is anticipated that the principles of the present invention are to be employed in a whole set of golf clubs and it will be appreciated that the lengths of the golf clubs in the set increase as the clubs progress from putters, wedges and the like up to the driver and other woods.

It has been found that the longer clubs of a set of golf clubs should have second golf club segments which are shorter than the second golf club segments of the shorter clubs of the set of golf clubs.

For example, a sand wedge constructed in accordance with the teachings of the present invention could incorporate a second club shaft segment in the order of one and one-half inches in length while a driver advantageously has a shorter second golf club segment which may be in the order of one-half inch in length. Of course the precise dimensions and configuration of any particular club can be varied depending upon the individual requirements of a golfer. However, as stated above, it is deemed advantageous to have the lengths of the second club shaft segments vary in inverse proportion to the lengths of the clubs.

Figure 17:
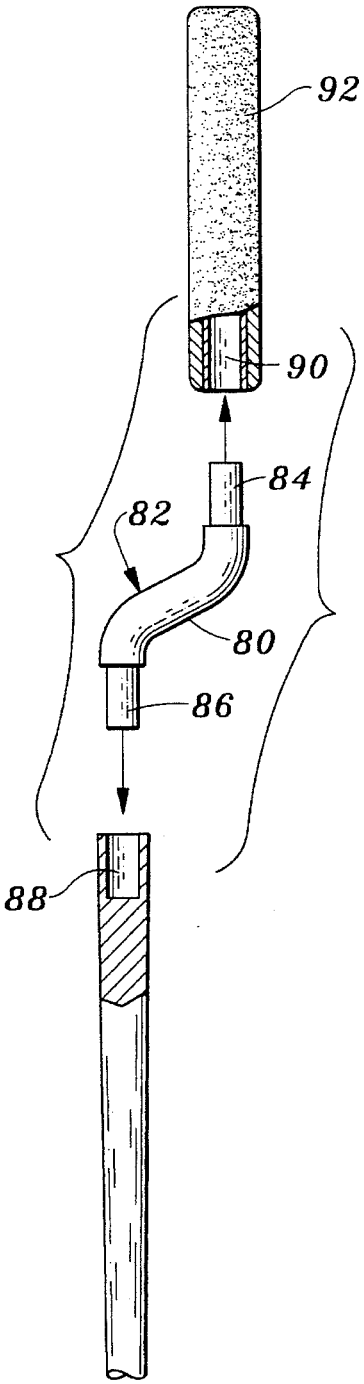
FIG. 17 is an exploded, enlarged side view of a portion of a club constructed in accordance with the teachings of the present invention wherein a segment of the club shaft is in the form of an insert attachable to other segments of the club shaft.
Figure 19:
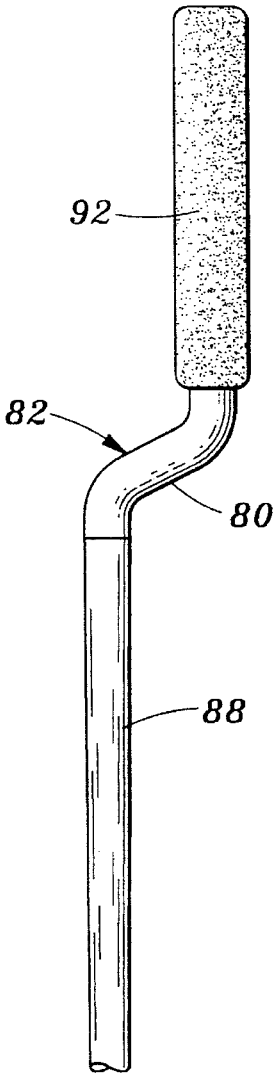
FIG. 19 illustrates the arrangement of FIG. 17 fully assembled.

FIGS. 17 and 19 illustrate an alternative arrangement or embodiment of the invention wherein the second club shaft segment 80 is incorporated in an insert 82 having reduced ends 84, 86 which are received by the adjoining elements of the club, namely the first club shaft segment 88 and the third club shaft segment 90 having a handle 92 secured thereabout. The insert incorporates two spaced bends as was the case with the second club shaft segments previously described which were integral with the rest of the shaft. The insert may be attached to the other elements of the club in any desired fashion, for example by friction fit or thread securement.

Figure 18:
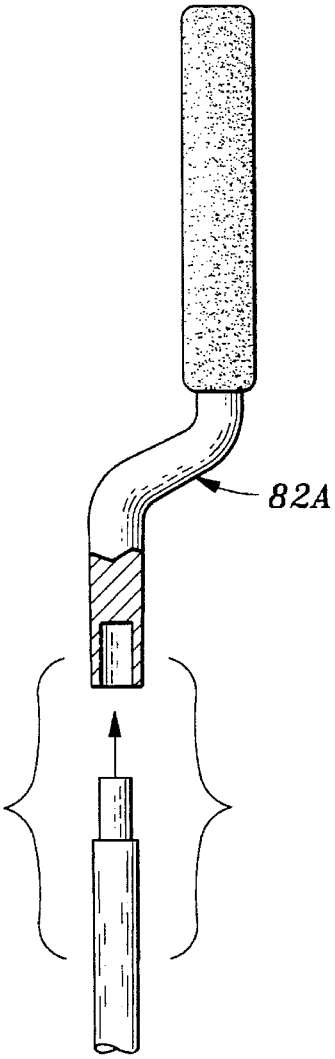
FIG. 18 is a view similar to FIG. 17 but illustrating an alternative embodiment of the club.

FIG. 18 illustrates an insert 82A in which the lower leg of the insert comprises a more significant portion of the first club shaft segment. It will be appreciated that the insert employed in a club may be one of a plurality of inserts of differing sizes and configurations selectively alternatively connectable to the first and third club shaft segments to selectively vary the distance between the first imaginary line X and the second imaginary line Y, described above.

I claim:

1. A golf club comprising, in combination:

a club head having a golf ball engaging surface;

a club shaft fixedly attached to said club head and extending upwardly from said club head, said club shaft including a substantially straight first club shaft segment extending, upwardly from said club head along a first imaginary line, a substantially straight second club shaft segment adjoining and connected to said first club shaft segment and extending upwardly and laterally relative to said first club shaft segment, and a substantially straight third club shaft segment adjoining and connected to said second club shaft segment at a location spaced from said first club shaft segment and extending upwardly from said second club shaft segment along a second imaginary line spaced from said first imaginary line; and an elongated club handle connected to said third club shaft segment at a location spaced from said second club shaft segment, said club handle being offset relative to said first club shaft segment, and said first imaginary line intersecting the ground at a location closer to a golfer holding the golf club by said club handle and swinging the golf club to strike a golf ball than the location of intersection between said second imaginary line and the ground at the time of golf ball contact by said golf ball engaging surface said first, second and third club shaft segments being non-integral and said second club shaft segment being one of a plurality of inserts of differing sizes selectively alternatively connectable to said first and third club shaft segments to selectively vary the distance between said first imaginary line and said second imaginary line.

2. The golf club according to claim 1 wherein said handle is canted relative to said first club shaft segment.

3. The golf club according to claim 2 wherein said club handle is canted in the direction of a golfer using the golf club.

4. The golf club according to claim 2 wherein said club handle is canted in a forward direction.

5. The golf club according to claim 2 wherein said club handle is canted in a rearward direction.

6. A set of golf clubs, each golf club of said set of golf clubs comprising, in combination:

a club head having a golf ball engaging surface;

a club shaft fixedly attached to said club head and extending upwardly from said club head, said club shaft including a substantially straight first club shaft segment extending upwardly from said club head along a first imaginary line, a substantially straight second club shaft segment adjoining and connected to said first club shaft segment and extending upwardly and laterally relative to said first club shaft segment, and a substantially straight third club shaft segment adjoining and connected to said second club shaft segment at a location spaced from said first club shaft segment and extending upwardly from said second club shaft segment in a second imaginary line spaced from said first imaginary line; and an elongated club handle connected to said third club shaft segment at a location spaced from said second club shaft segment, said club handle being offset relative to said first club shaft segment, and said first imaginary line intersecting the ground at a location closer to a golfer holding the golf club by said club handle and swinging the golf club to strike a golf ball than the location of intersection between said second imaginary line and the ground at the time of golf ball contact by said golf ball engaging surface, the lengths of the second golf club segments of at least some of the golf clubs of the set of golf clubs differing from the lengths of at least some of the other of the golf clubs of the set of golf clubs.

7. The set of golf clubs according to claim 6 wherein the club shafts of the golf clubs of the set of golf clubs vary in length and wherein the second golf club segments of longer clubs of the set of golf clubs are shorter than the second golf club segments of shorter clubs of the set of golf clubs.

8. A golf club comprising, in combination:

a club head having a golf ball engaging surface;

a club shaft fixedly attached to said club head and extending upwardly from said club head, said club shaft including a substantially straight first club shaft segment extending upwardly from said club head along a first imaginary line, a substantially straight second club shaft segment adjoining and connected to said first club shaft segment and extending upwardly and laterally relative to said first club shaft segment, and a substantially straight third club shaft segment adjoining and connected to said second club shaft segment at a location spaced from said first club shaft segment and extending upwardly from said second club shaft segment along a second imaginary line spaced from said first imaginary line; and an elongated club handle connected to said third club shaft segment at a location spaced from said second club shaft segment, said club handle being offset relative to said first club shaft segment, and said first imaginary line intersecting the ground at a location closer to a golfer holding the golf club by said club handle and swinging the golf club to strike a golf ball than the location of intersection between said second imaginary line and the ground at the time of golf ball contact by said golf ball engaging surface, said first, second and third club shaft segments being non-integral and said second club shaft segment being one of a plurality of inserts of differing configurations selectively alternatively connectable to said first and third club shaft segments.

* * * * *